United States Patent [19]

Engel

[11] Patent Number: 4,553,463

[45] Date of Patent: Nov. 19, 1985

[54] PORTABLE WOOD CUTTING DEVICE

[76] Inventor: Richard C. Engel, 3208 Windsor Rd., Orrwell, Ohio 44076

[21] Appl. No.: 511,872

[22] Filed: Jul. 8, 1983

[51] Int. Cl.[4] ..... B27B 17/08

[52] U.S. Cl. ..... 83/796; 83/545; 83/571; 83/574; 83/589; 83/860; 123/398; 192/138; 193/35 R; 200/330; 269/17; 269/295

[58] Field of Search ..... 83/436, 574, 793–797, 83/928, 169, 799, 860, 543, 589, 571; 30/371, 374–377, 379.5, 383; 193/35 R; 200/330; 192/138, 143; 43/59, 61, 84; 123/398; 269/1, 17, 130, 131, 295

[56] References Cited

U.S. PATENT DOCUMENTS

| | | | |
|---|---|---|---|
| 1,795,192 | 3/1931 | York | 193/35 R X |
| 2,529,684 | 11/1950 | Gass | 193/35 R X |
| 2,759,501 | 8/1956 | Kliever | 83/797 |
| 2,851,067 | 9/1958 | Greenslate | 83/796 |
| 3,364,960 | 1/1968 | Collins et al. | 83/797 |
| 4,215,612 | 8/1980 | Peel | 83/574 X |
| 4,342,243 | 8/1982 | Porritt | 83/574 |

*Primary Examiner*—Douglas D. Watts
*Attorney, Agent, or Firm*—Body, Vickers & Daniels

[57] ABSTRACT

A chain saw mounting assembly wherein a chain saw is pivotally mounted at the motor housing end, on a support frame, for pivotal movement in the cutting plane of the saw blade. A throttle actuator on the assembly regulates the speed of the cutting chain between idling speed, when the saw is in its inoperative pivoted position, and an accelerated cutting speed when the saw is in its pivoted operating position. The device is adaptable for mounting on a workpiece supporting table.

9 Claims, 4 Drawing Figures

PORTABLE WOOD CUTTING DEVICE

BACKGROUND OF THE INVENTION

This invention relates, in general, to cutting apparatus for lumber and sawable material and, more specifically, to cutting apparatus forming an integrated chain saw and work supporting assembly.

Over the past few years there has been a resurgence in the use of wood burning stoves and fireplaces in the home. This growing use, resulting from reasons such as personal preference or economy, has created a great demand for firewood. Persons meeting this demand for either their own personal use or for sale to others have a need for a convenient, portable cutting device to perform this work as easily and economically as possible.

It is generally known that saws set on a level cutting table provide an acceptable arrangement for cutting large quantities of cuttable material, and particularly lumber. Such saws, however, require an on-site power source. Often an electric power source is provided to drive the cutting blade. However, the area in which such an electric saw may be used is limited by the ability to supply the power source. Thus, the use of electric power is limited to areas served by electric power transmission lines or where a generator may be brought. Other saws heretofore known have used a power take-off from a truck or tractor. The use of this type of power source is, of course, limited to areas where a truck or tractor may be driven. A device with these limitations is not particularly portable, and is only suited for use in the limited applications in which the device may be easily assembled and conveniently powered.

Chain saws have rapidly improved in their operational characteristics since their original introduction. Such saws are suitable for use and operation where it is otherwise impossible to set up a large, externally powered saw. At this time, such saws are readily available at reasonable cost in a variety of sizes. A chain saw carries its own power source in the form of a reliable internal combustion engine mounted on the saw. No other on-site power generation is necessary. By virtue of this factor, a self-powered chain saw may be brought to and operated without concern for an auxiliary power source. Thus, a chain saw may be used in wooded and otherwise secluded areas where it would be difficult, if not impossible, to bring a saw with an external power source.

However, chain saws have certain inherent dangers and problems associated with their use. The primary danger is in the rapidly moving, unguarded cutting chain. As is readily apparent, the cutting chain is dangerous while in motion and capable of causing severe injury. In addition, when the moving chain first touches a workpiece, it tends to bounce off the workpiece, causing the saw to "kick-back," exposing the operator to the unguarded blade end of the saw.

Another problem associated with the use of a chain saw is operator fatigue caused by the constant vibrational motion of the saw, the weight of the saw, and the normal exertion caused by manual labor. These problems may compound into a dangerous condition, causing operator carelessness, and possible injury.

These and other disadvantages of prior mechanisms for cutting wood have been overcome by the present invention, which is directed to a mounting assembly for a chain saw providing a safe and portable operating arrangement therefor.

SUMMARY OF THE INVENTION

The present invention contemplates a new and improved wood cutting apparatus which overcomes all of the above referred to problems and others and provides a selfsupported saw arrangement which employs a chain saw and is of simple and easily operating construction.

In accordance with one aspect of the present invention, there is provided a chain saw mounting assembly wherein a chain saw is pivotally mounted at its motor housing end on a support frame, for pivotal movement in the cutting plane of the saw blade. Control means are provided for actuating the chain saw throttle, during the pivotal movement of the chain saw from its non-cutting position to its cutting position, to thereby regulate the operating speed of the cutting chain.

In accordance with another aspect of the invention, means are provided to bias the chain saw to a non-cutting position. Handgrip means on the free end of the saw blade, permit an operator to swing the chain saw between its non-cutting and cutting positions against the biasing means.

In accordance with yet another aspect of the invention, the chain saw mounting assembly is associated with a workpiece supporting table along which a workpiece may be advanced into cutting position at the cutting plane of the saw. The table may be provided with workpiece supporting rollers, skewed in a manner to drive and maintain the workpiece against a guide rail on the table during the feeding of the workpiece therealong to the cutting plane of the saw.

The principal object of the invention is the provision of a mounting assembly for supporting a chain saw in operational relationship with a workpiece to be cut.

Another object of the invention is the provision of a chain saw mounting assembly of the above referred to character which is portable and operable at a location remote from an auxiliary source of energy.

Still another object of the invention is the provision of a chain saw mounting assembly of the above referred to character wherein movement of the chain saw in its workpiece cutting stroke actuates the throttle thereof.

A further object of the invention is the provision of a chain saw mounting assembly of the above referred to character having a workpiece supporting surface integrally associated therewith.

A still further object of the invention is a chain saw mounting assembly of the above mentioned character which is easy in operation, safe in use, and positive in action.

Further objects and advantages of the invention will appear from the following detailed description of a preferred embodiment thereof and from the accompanying drawings.

BRIEF DESCRIPTION OF THE DRAWINGS

In the drawings:

Referring now to the drawings, wherein the showings are for the purpose of illustrating a preferred embodiment of the invention only and not for the purpose of limiting the same, the drawings show a chain saw mounting assembly according to the invention, for supporting a chain saw in operational cutting relationship to a workpiece. As shown in FIG. 1, chain saw A is pivotally mounted on mounting assembly B which is, in turn, attached to a workpiece supporting table C. Table C supports workpieces L such as lumber or logs in position to be cut to a desired length by chain saw A. When not in use, chain saw A is biased out of cutting position by counterweight arrangement D.

Figure 1:
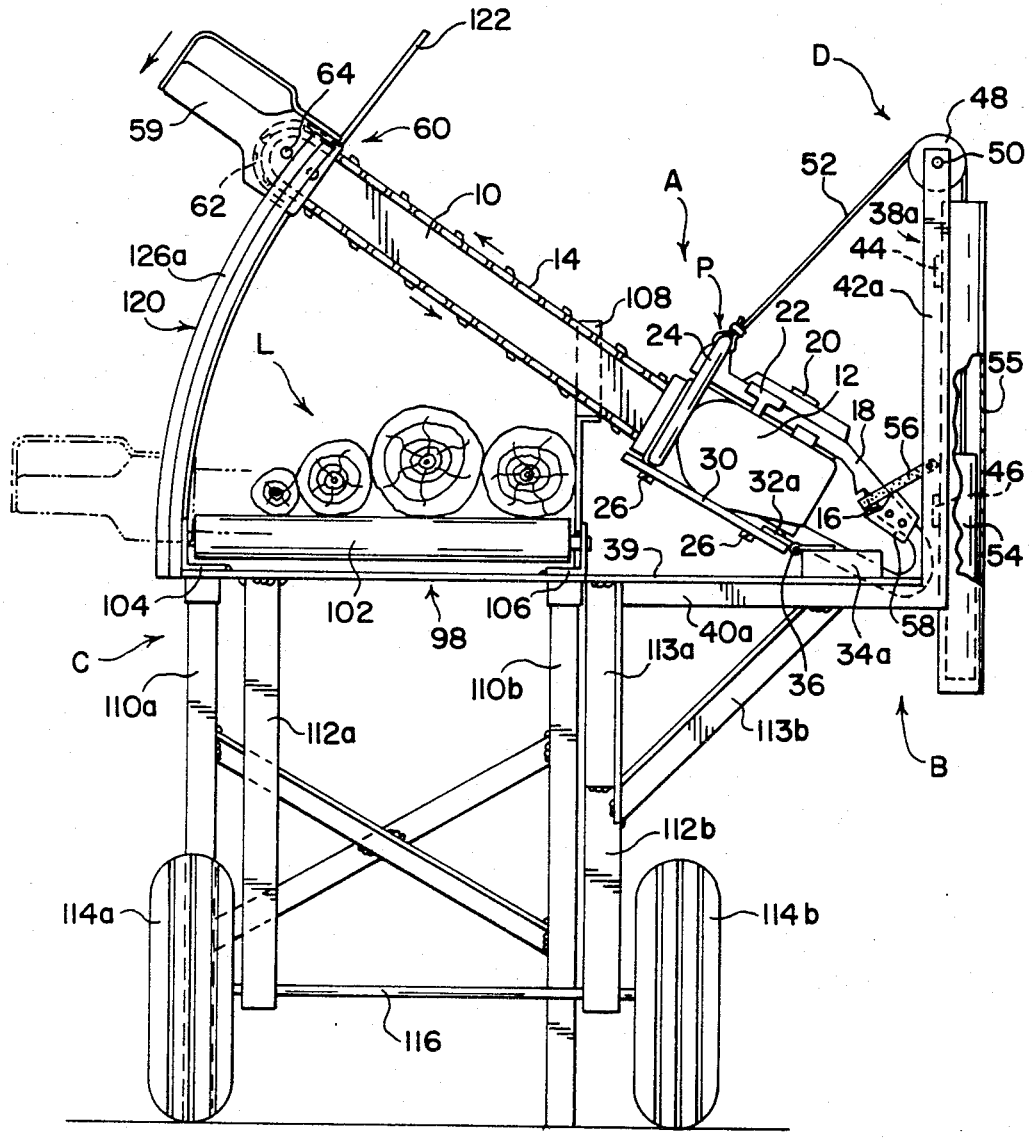
FIG. 1 is a front elevational view of a chain saw mounting assembly incorporating the concept of the present invention.

Chain saw A is of a standard readily available type, such as that made by the STIHL Company of West Germany. A chain saw of the preferred type has a blade portion 10 supported by and projecting from one end of a motor housing 12. About the periphery of the blade 10, a cutting chain 14 is driven, by the chain saw motor (not shown) contained within housing 12, at a high rate of speed to achieve the cutting action of the chain saw. The operation of the chain saw, whereby the cutting chain 14 is accelerated between an idling non-cutting speed and an accelerated cutting speed, is controlled by throttle lever 16, located on the inside of chain saw hand grip 18. On depression of the throttle lever 16, inwardly of the hand grip, the chain saw motor is accelerated, thereby driving the cutting chain 14 at cutting speed. On release of the throttle lever 16, the lever returns to its original outward position by means customarily provided in chain saws, and the chain saw motor returns to idling speed. Chain saw A is also provided with such standard features as fuel tank 20 motor starter 22, and supplementary hand grip 24.

Chain saw A is mounted on mounting assembly B. To this end, motor housing 12 is removably attached by suitable fasteners, such as fastening bolts 26, to mounting plate 30. Mounting plate 30 is generally flat, about threequarters inch thick, and of either wood or metal construction. Mounting plate 30 is of a size to permit the entire bottom of the motor housing 12 to rest on it. Mounting plate 30 is attached by hinges 32*a* and 32*b*, best seen in FIG. 3, to mounting blocks 34*a* and 34*b*. Hinges 32*a* and 32*b* form the hinge axis 36 about which the chain saw A may pivot between a lowered, cutting position shown in phantom, in FIG. 1, and a raised, non-cutting position shown in blocks 34*a* and 34*b* are attached to flat base plate 39 which is supported by two L-shaped members, 38*a* and 38*b*. L-shaped member 38*a* has a horizontal leg member 40*a* and a vertical leg member 42*a* upstanding therefrom. As will be appreciated, L-shaped member 38*b* is identical in construction to L-shaped member 38*a*, not shown. L-shaped support members 38*a* and 38*b* may be formed from structural steel members.

Flat plate 39 is supported on the horizontal leg members of L-shaped members 38*a* and 38*b*. Plate 39 is provided with a recess (not shown) at the side edge closest to the vertical members 42*a* and 42*b*, to receive the portion of the chain saw A which may extend beyond the surface of plate 39 in the raised, inoperative position of the saw, thus allowing the saw to be biased upward by the counterweight arrangement D to the idle non-cutting position. The plate 39 ties the horizontal members together, maintaining such members in spaced, side-by-side relationship, and also acts as a stop to define the lowest position of the chain saw. As the chain saw is lowered through the cutting position shown in phantom, mounting plate 30 impinges upon plate 39, thereby defining the lowest position of the saw.

Upper vertical members 42*a* and 42*b* are held in side-by side spaced relationship by tie members 44 and 46. Together with plate 39, the tying members join the L-shaped members 38*a* and 38*b* into rigid support frame.

Mounting assembly B also supports counterweight arrangement D. At the uppermost point of the vertical members 42*a*, 42*b*, and between such members, a pulley wheel 48 is rotatably mounted on an axle 50. Axle 50 is supported on and between vertical members 42*a*, 42*b*. In a preferred embodiment, pulley wheel 48 is about three inches in diameter. Pulley wheel 48 supports pulley cable 52, which is attached at one end to hand grip 24 on motor housing 12, and at the other end to counterweight 54. Cable 52 may be a three-sixteenths inch steel cable, and is preferably attached to hand grip 24 at point P. The counterweight 54 is of a weight sufficient to bias the saw in the upward pivoted direction and hold it in its raised inoperative position when no downward force is applied, and in this embodiment is about twenty pounds in weight. The counterweight 54 is located between vertical members 42*a*, 42*b*, and is confined to vertical movement within hollow tube 55 which is attached to the members 44 and 46.

In accordance with the present invention, means are provided to control throttle lever 16 when the saw is swung to its downward pivoted cutting position. In the particular illustrated case, the throttle control means comprises a stiffly elastic strip 56 adapted to engage with throttle lever 16. Opposite ends of the elastic strip 56 are secured to respective ones of the vertical members 42*a*, 42*b* at points somewhat above throttle lever 16. Elastic strip 56 is in straddling engagement with throttle lever 16. Such strip 56 stretches and actuates lever 16 on downward motion of the saw. Elastic strip 56 is maintained in engaged relationship at all times with the throttle lever 16 by a strip support piece 58, which is secured on the hand grip 18 below throttle lever 16, thereby preventing elastic strip 56 from sliding out of engagement relationship with throttle lever 16.

Tailstock handle 59 is provided at the free end 60 of saw blade 10. The handle in the preferred embodiment is provided with a cavity 62, generally conforming to the shape of the saw blade, but of course, larger to enable the cutting chain 14 to pass therethrough without obstruction. Tailstock handle 59 is suitably fastened in position on saw blade 10 by means such as rivets or bolts, indicated as 64 in the drawings. Tailstock handle 59 is of a shape which allows it to be easily grasped by an operator.

Figure 3:
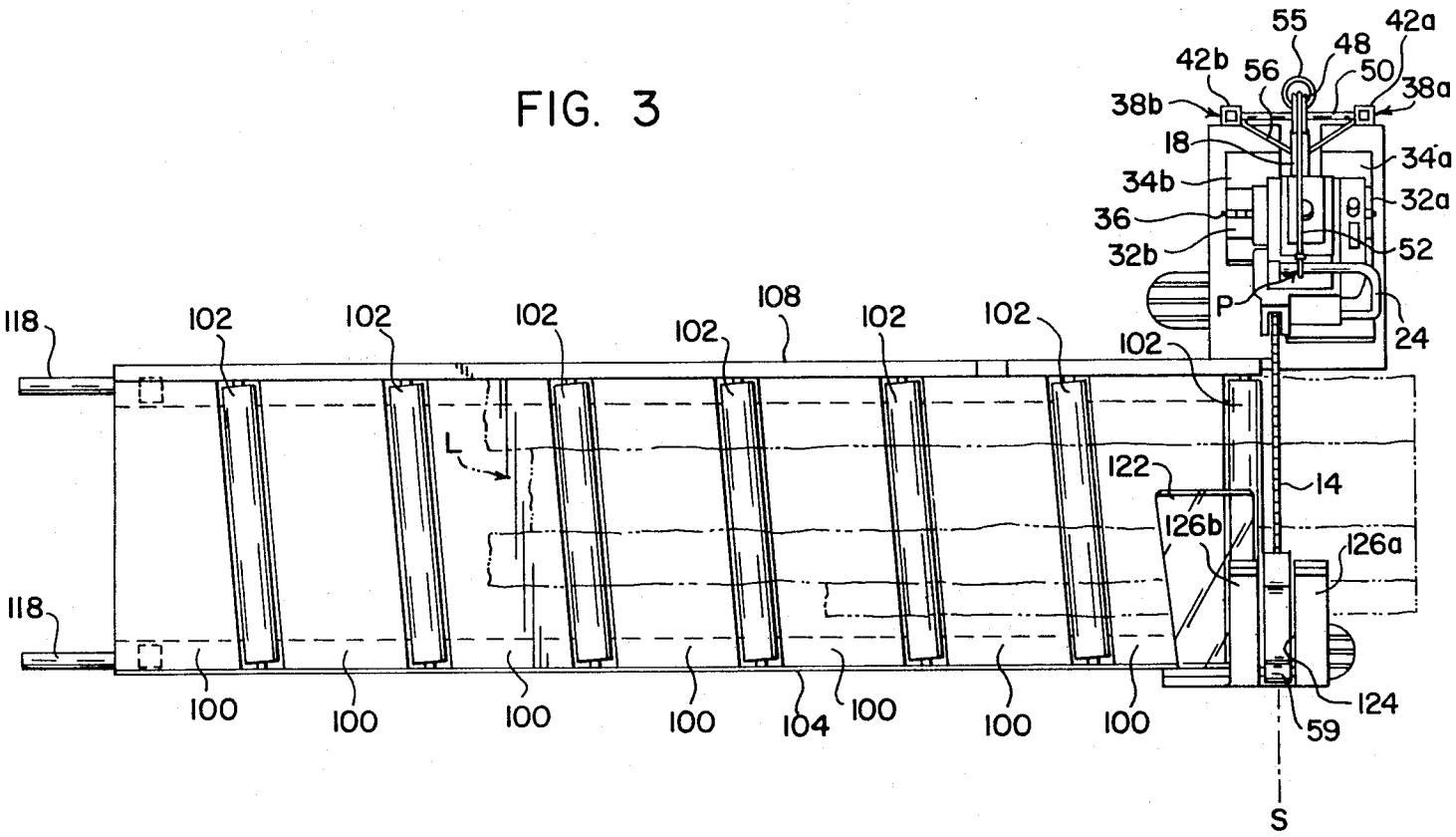
FIG. 3 is a top view of the assembly shown in FIG. 1.

In the preferred embodiment, the mounting assembly B is mounted on the workpiece support table C. It will be appreciated, however, that the described chain saw A, mounting assembly B, and counterweight arrangement D may be mounted for use with any work supporting device. Workpiece support table C includes a bed assembly 98 comprised of side rail members 104 and 106 and a plurality of table top secions 100 spaced apart along the length of and secured to the rails. Horizontal rollers 102 are located between the sections 100 and rotatably mounted in the rails 104 and 106, with their upper surfaces disposed slightly above table top sections 100, defining a workpiece support plane to support workpieces in a reduced frictional relationship on table sections 100. The rollers may be about two and one-half inches in diameter, and are horizontally canted or skewed, as best shown in FIG. 3, so that the end of each roller mounted in table rail 104 is closer to the saw blade than its other end. Moving a workpiece L along rollers canted in this manner results in the workpiece being forced laterally against a guide rail 108. Guide rail 108 is fixed along table rail 106 and rises to a sufficient height from the upper surface of the table top section to prevent workpieces from falling from the table, and provides a surface along which workpieces may be directed into the cutting plane S of the saw and cutting relationship with the saw blade 10. Bed assembly 98 does not extend through cutting plane S so that possible engagement of the bed assembly and the cutting chain 14 is avoided.

Bed assembly 98 is supported at opposite ends by support legs shown as 110*a*, 110*b*, 112*a*, and 112*b*. As will be appreciated, the support legs hold the bed assembly 98 at a height allowing the operator to conveniently operate the chain saw assembly. The support leg 112*b* also supports the mounting assembly B in place of the table C as by the welded attachment of the base plate 39 of the mounting assembly to the upper end of the table leg 112*b* and the welded attachment of the base plate 39 and horizontal leg member 40*b* to angle brace members 113*a* and 113*b* welded to the table leg 112*b*.

Wheels 114*a* and 114*b*, best seen in FIG. 1, are rotatably mounted on axle 116, which is mounted through and between the lower ends of legs 112*a* and 112*b*. The combination height of the wheels 114*a*, 114*b* and legs 112*a*, 112*b* should be equal to the height of legs 110*a*, 110*b*, thereby providing a level work surface when the entire assembly is in a stationary position on level ground. Handles 118 located at the end of and attached to the bed assembly 98 opposite the saw, provide a grip for the operator to lift the table when it is desired to move the entire assembly about. Thus, the assembly may be rolled about in the same manner as a wheelbarrow.

Figure 2:
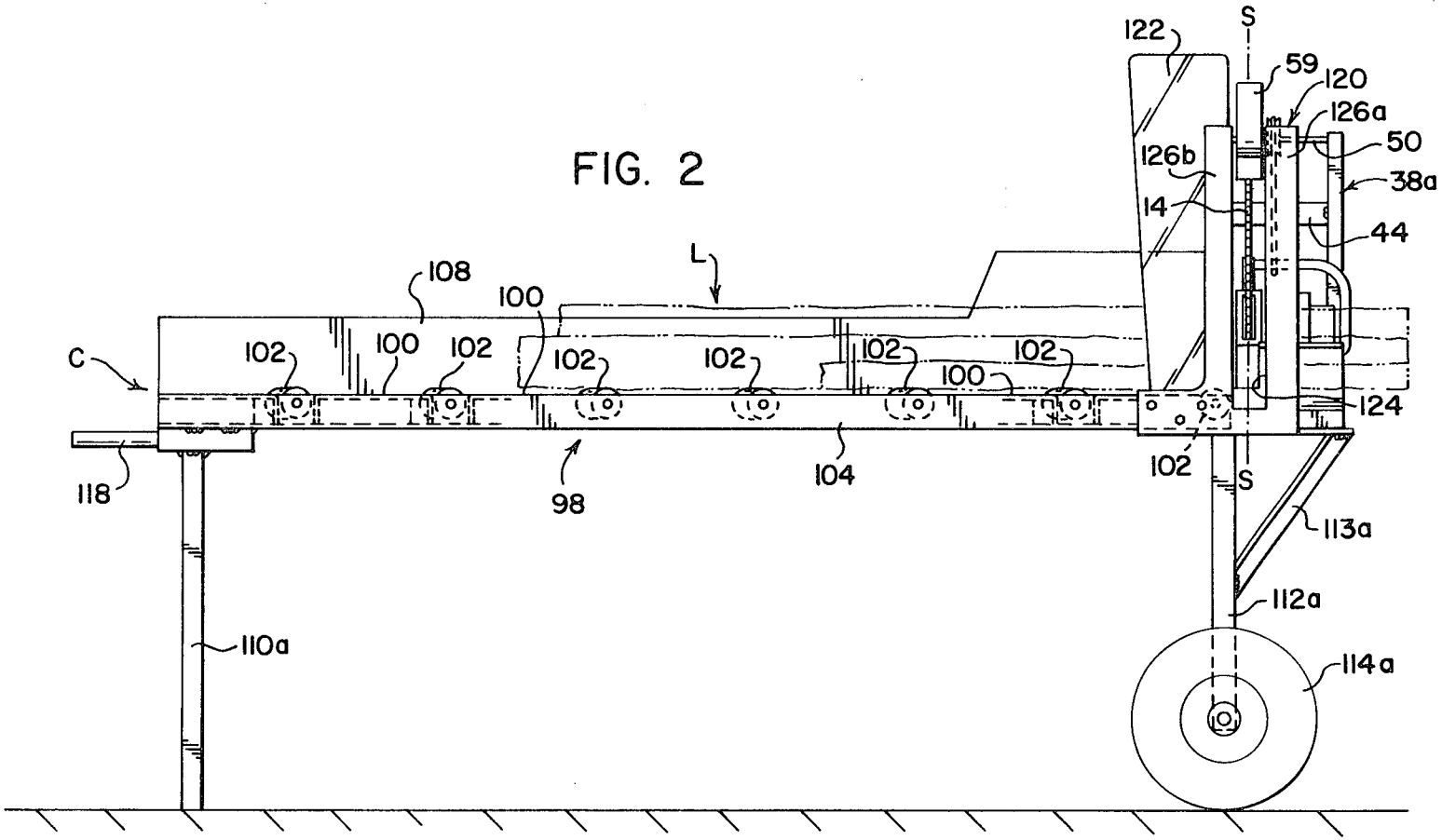
FIG. 2 is a side elevational view of the assembly shown in FIG. 1.

Referring to FIG. 2, a saw handle guide 120 and shield 122 are mounted on table rail 104. Saw handle guide 120 provides a narrow slot 124, to confine the saw handle 59 and thus the saw blade 10 to planar movement in the saw cutting plane S, defined by the pivoting movement of saw blade 10. This feature prevents the saw blade 10 from binding in the workpiece during the sawing thereof and being damaged. Shield 122 protects the operator from flying debris caused by the sawing operation of the chain saw. It is also made of transparent material to allow the operator to clearly view the cutting operation. In the preferred embodiment, the saw handle guide 120 is a generally U-shaped member of sturdy plastic, with upright portions 126*a* and 126*b* forming the guide slot 124. The guide 120 is fastened therealong. Shield 122 extends from a height adequate to protect the operator's face from flying debris to the table rail 104. In practice, the shield 122 is generally formed of a material such as transparent plexiglass.

Figure 4:
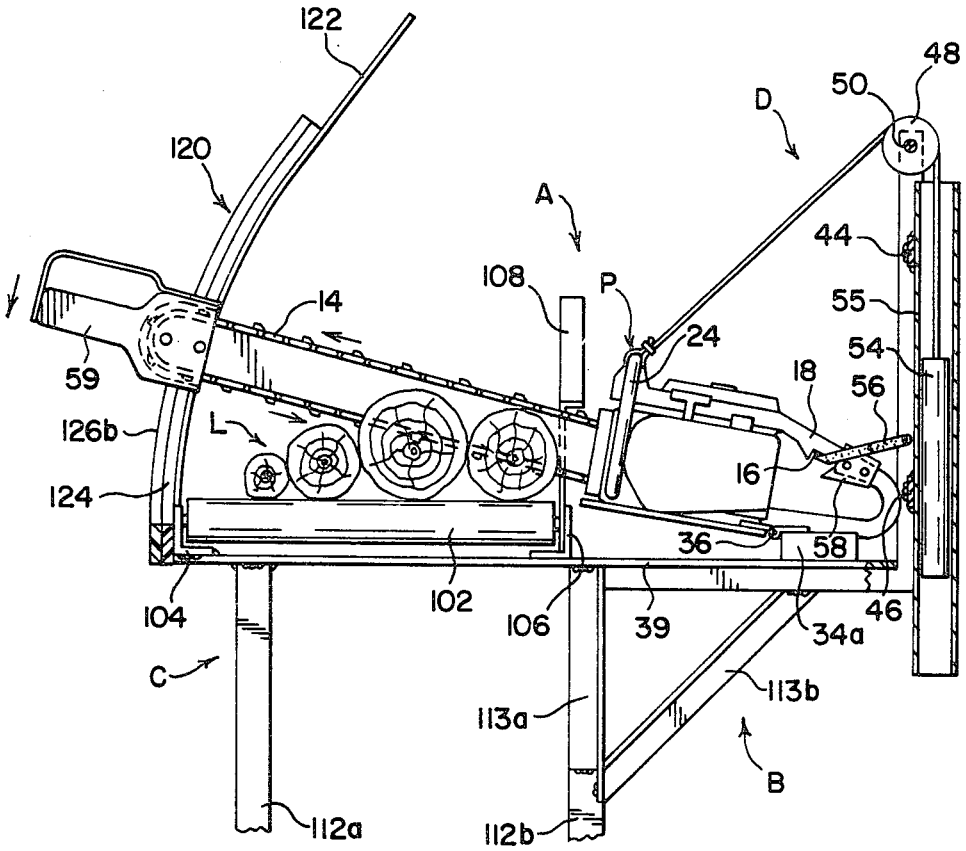
FIG. 4 is an in-process view, similar to FIG. 1, showing the chain saw in the process of cutting a workpiece.

Referring back to FIG. 1, in operating the chain saw assembly comprising the invention the chain saw A is initially in its upwardly pivoted position, with the saw motor idling and the cutting chain 14 not moving. Workpieces L may be placed on the workpiece support table C to move into desired cutting position relative to the cutting S of the saw. On reaching this desired position, the operator grasps the tailstock handle 59 and pulls it in the downward pivoted direction thereby overcoming the biasing of the counterweight arrangement D. The chain saw A follows and is pivoted downwardly about the axis 36. The pivoting action draws the elastic strip 56 into tight engagement with the throttle lever 16, thereby depressing the lever 16 and accelerating the motor to cutting speed. As the saw continues its downward pivoting motion, the elastic strip 56 continues to tighten, and maintains the depression of the throttle lever 16 as the saw cuts through the workpiece. The operator needs to exert about 4 pounds of pressure on the tailstock handle, with only one hand, to operate the mounted chain saw assembly. By comparision, a free standing chainsaw with a 24 inch blade weighs about 20.3 pounds and requires two hands to operate. FIG. 4 is an in-process view of the cutting action of the chain saw and illustrates its operation upon being moved in a downward pivoted sawing direction.

When the workpiece has been cut as desired, the operator releases the saw handle 59. The counterweight 54 is then free to fall, since it is no longer being overcome by the operator, and thus the saw is biased upwardly by the counterweight arrangement D back to the upwardly pivoted idle position. As the saw reaches the upper pivoted position, tension on the elastic strip 56 is released, thereby loosening its engagement with and releasing the throttle lever 16, causing the motor to return to idling speed.

Upon completion of the cutting operation, and with the chain saw in a safely idling condition, the operator may easily push the workpieces L along the rollers 102 on the workpiece into a new cutting position on the table C in readiness for the start of the next cutting operation.

It is appreciated that the present invention has been described in connection with one structural embodiment; however, various changes may be made in this embodiment without departing from the intended spirit and scope of the present invention.

Having thus described the invention, it is claimed:

1. A mounting assembly for a chain saw having a body portion comprised of a driving motor and a motor housing; a generally elongated blade projecting from said motor housing and having a cutting chain drivable about the periphery of the blade by the motor, said chain having a cutting run and defining a cutting plane with said blade, said motor having a throttle for accelerating said chain between an idling speed and a cutting speed; said mounting assembly comprising: a support frame including means thereon for mounting said motor housing for pivotal movement in said cutting plane of said saw about a horizontal axis adjacent to the motor housing between an elevated non-cutting position and a lowered cutting position; a handle means attached to said chain saw blade at the free end thereof for direct operator movement of the blade between said elevated non-cutting and lowered cutting positions; and throttle actuating means comprising a stiffly elastic strip member straddling and engageable with said throttle on downward movement of the saw blade and secured at the opposite ends of said member to said support frame so as to be elastically stretched by the throttle on downward movement of the saw blade from its elevated non-cutting position to its lowered cutting position, thereby effecting actuation of the throttle during the downward motion of the blade and maintaining the throttle in actuated position until the blade is returned to the elevated non-cutting position.

2. A mounting assembly as defined in claim 1, wherein said assembly includes means for biasing said chain saw to said elevated non-cutting position.

3. A mounting assembly as defined in claim 1, wherein said means for pivotally mounting said motor housing includes a mounting plate for attachment of said motor housing thereto, said plate being pivotally mounted on said support frame for pivotal movement about said axis.

4. A mounting assembly as defined in claim 3 including guide means confining said handle means to a fixed arcuate path, thereby maintaining said blade in fixed latitudinal relationship with said cutting plane during pivotal movement of said saw.

5. A mounting assembly as defined in claim 4 wherein a guard member is provided integral with and adjacent to the guide means whereby the operator is protected from ejected debris during the cutting operation.

6. Apparatus for sawing cuttable material, said apparatus comprising a chain saw, said chain saw having a body portion comprised of a driving motor and a motor housing, a generally elongated blade projecting from said motor housing and having a cutting chain drivable about the periphery of the blade by said motor, said cutting chain having a cutting run and defining with said blade a cutting plane, said motor having a throttle for accelerating said cutting chain between an idling speed and a cutting speed, a mounting assembly for said chain saw comprising: a support frame including means thereon for mounting said motor housing for pivotal movement of said saw about an axis adjacent to the motor housing and perpendicular to said cutting plane between an elevated non-cutting position and a lowered cutting position; a handle attached to said chain saw blade at the free end thereof for operator movement of the blade between said non-elevated non-cutting and lowered cutting positions; throttle actuating means comprising a stiffly elastic strip member straddling and engageable with said throttle and secured at its opposite ends to said support frame so as to be elastically stretched by the throttle downward movement of the saw blade from its elevated non-cutting position to its lower cutting position thereby effecting actuation of the throttle during the downward motion of the blade; and a workpiece supporting table associated with said saw and mounting assembly having a horizontal planar supporting surface for supporting said cuttable material in cutting relationship with said saw blade, said planar supporting surface being disposed perpendicularly to and intersecting said cutting plane at said cutting position of said saw.

7. The apparatus as described in claim 6, wherein said workpiece supporting table is provided with a guide rail upstanding from the supporting surface thereof and extending perpendicularly to said cutting plane for guiding the workpiece in a direction intersecting said cutting plane.

8. The apparatus as described in claim 6, wherein said workpiece supporting table is provided with rollers, rotatably mounted in said table at the supporting surface thereof and at an angle divergining slightly from the perpendicular to said guide rail for supporting said workpiece in reduced frictional relationship with said table and urging the workpiece against said guide rail during its advance movement along the table toward the saw.

9. The apparatus as described in claim 7 wherein said mounting assembly includes means for biasing said chain saw to said elevated non-cutting position.

* * * * *